US010018936B2

(12) United States Patent
Niijima

(10) Patent No.: US 10,018,936 B2
(45) Date of Patent: Jul. 10, 2018

(54) IMAGE FORMING APPARATUS

(71) Applicant: Oki Data Corporation, Tokyo (JP)

(72) Inventor: Yoshio Niijima, Tokyo (JP)

(73) Assignee: Oki Data Corporation, Tokyo (JP)

( * ) Notice: Subject to any disclaimer, the term of this patent is extended or adjusted under 35 U.S.C. 154(b) by 32 days.

(21) Appl. No.: 15/358,921

(22) Filed: Nov. 22, 2016

(65) Prior Publication Data

US 2017/0184993 A1 Jun. 29, 2017

(30) Foreign Application Priority Data

Dec. 24, 2015 (JP) ..... 2015-250978

(51) Int. Cl.
*G03G 15/00* (2006.01)
*G03G 15/043* (2006.01)

(52) U.S. Cl.
CPC ..... *G03G 15/043* (2013.01)

(58) Field of Classification Search
CPC ..... G03G 15/043
See application file for complete search history.

(56) References Cited

U.S. PATENT DOCUMENTS

2010/0272455 A1* 10/2010 Muramoto ..... G03G 15/0822 399/43
2011/0002702 A1* 1/2011 Niijima ..... G03G 15/50 399/44

FOREIGN PATENT DOCUMENTS

JP 2008-242394 A 10/2008

* cited by examiner

*Primary Examiner* — David M Gray
*Assistant Examiner* — Michael Harrison
(74) *Attorney, Agent, or Firm* — Muncy, Geissler, Olds & Lowe, P.C.

(57) ABSTRACT

An image forming apparatus includes a first image carrier, a first exposure part that forms a first electrostatic latent image in dot units on the first image carrier, a first development part that develops the first electrostatic latent image of the first image carrier using a first developer, and a controller that forms an inclined first band pattern of which bands incline with respect to a main scanning line direction on the first image carrier with the first exposure part and the first development part.

21 Claims, 9 Drawing Sheets

IMAGE FORMING APPARATUS

CROSS REFERENCE TO RELATED APPLICATIONS

This application claims priority under 35 USC 119 to Japanese Patent Application No. 2015-250978 filed on Dec. 24, 2015 original document, the entire contents which are incorporated herein by reference.

TECHNICAL FIELD

The present invention relates to an image forming apparatus that forms an image.

BACKGROUND

In an image forming apparatus, for example, an electrostatic latent image that is formed on a surface of a photosensitive drum is developed using a charged toner. In this case, when printing of a low print ratio continues, the potential of the toner rises more than necessary, and so-called scumming, a phenomenon in which toner is attached to a margin portion, may occur. Patent Document 1 discloses an image forming apparatus in which a decrease in image quality is prevented by discarding the toner in accordance with the print ratio.

RELATED ART

[Patent Doc. 1] Japanese Laid-Open Patent Publication 2008-242394

In this way, in the image forming apparatus, improvement in image quality is desired, and further improvement in image quality is expected.

The present invention is accomplished in view of such a problem and is intended to provide image forming apparatus that allows image quality to be improved.

SUMMARY

An image forming apparatus disclosed in the application includes a first image carrier, a first exposure part that forms a first electrostatic latent image in dot units on the first image carrier, a first development part that develops the first electrostatic latent image of the first image carrier using a first developer, and a controller that forms an inclined first band pattern of which bands incline with respect to a main scanning line direction on the first image carrier with the first exposure part and the first development part.

According to the image forming apparatus of the present invention, based on the first cumulative exposure dot number, whether or not the first developer image having the inclined first band pattern is to be formed on the first image carrier is determined. Therefore, image quality can be improved.

BRIEF DESCRITPION OF THE DRAWINGS

DETAILED DESCRITPION OF THE PREFERRED EMBODIMENTS

In the following, embodiments of the present invention are described with reference to the drawings. The description will be made in the following order:

1. First Embodiment
2. Second Embodiment

<1. First Embodiment>

[Configuration Example]

Figure 1:
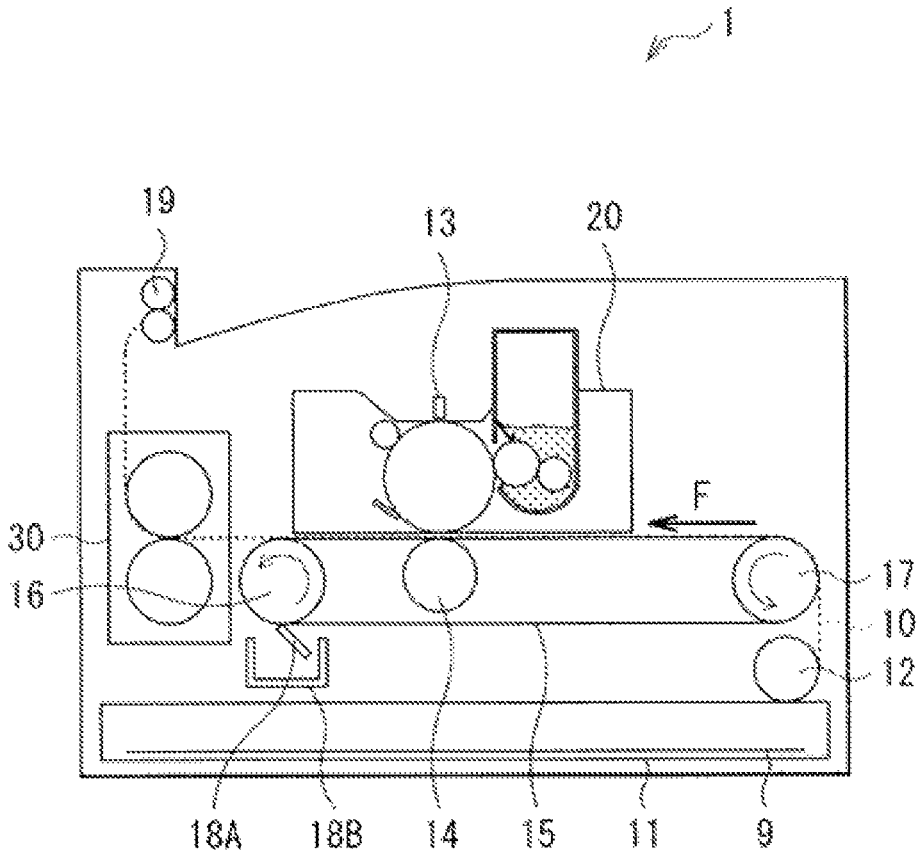
FIG. 1 is a explanatory diagram illustrating a configuration example of an image forming apparatus according to an embodiment of the present invention.

FIG. 1 illustrates a configuration example of an image forming apparatus (image forming apparatus 1) according to a first embodiment of the present invention. The image forming apparatus 1, for example, functions as a printer that forms an image using an electrophotographic method on a print medium made of an ordinary sheet. The image forming apparatus 1 includes a medium cassette 11, a pickup roller 12, an ID (Image Drum) unit 20, an exposure head 13, a transfer roller 14, a transfer belt 15, a drive roller 16, a driven roller 17, a cleaning blade 18A, a cleaner container 18B, a fuser 30, and an ejection roller 19.

In the medium cassette 11, a print medium 9 on which an image is to be formed is set. The pickup roller 12 is a member that takes out print media 9, which are accommodated in the medium cassette 11, one by one from top of the stack and feeds each of the taken out print media 9 to a carrying path 10.

The ID unit 20 forms a black toner image. The ID unit 20, for example, is configured to be detachable.

Figure 2:
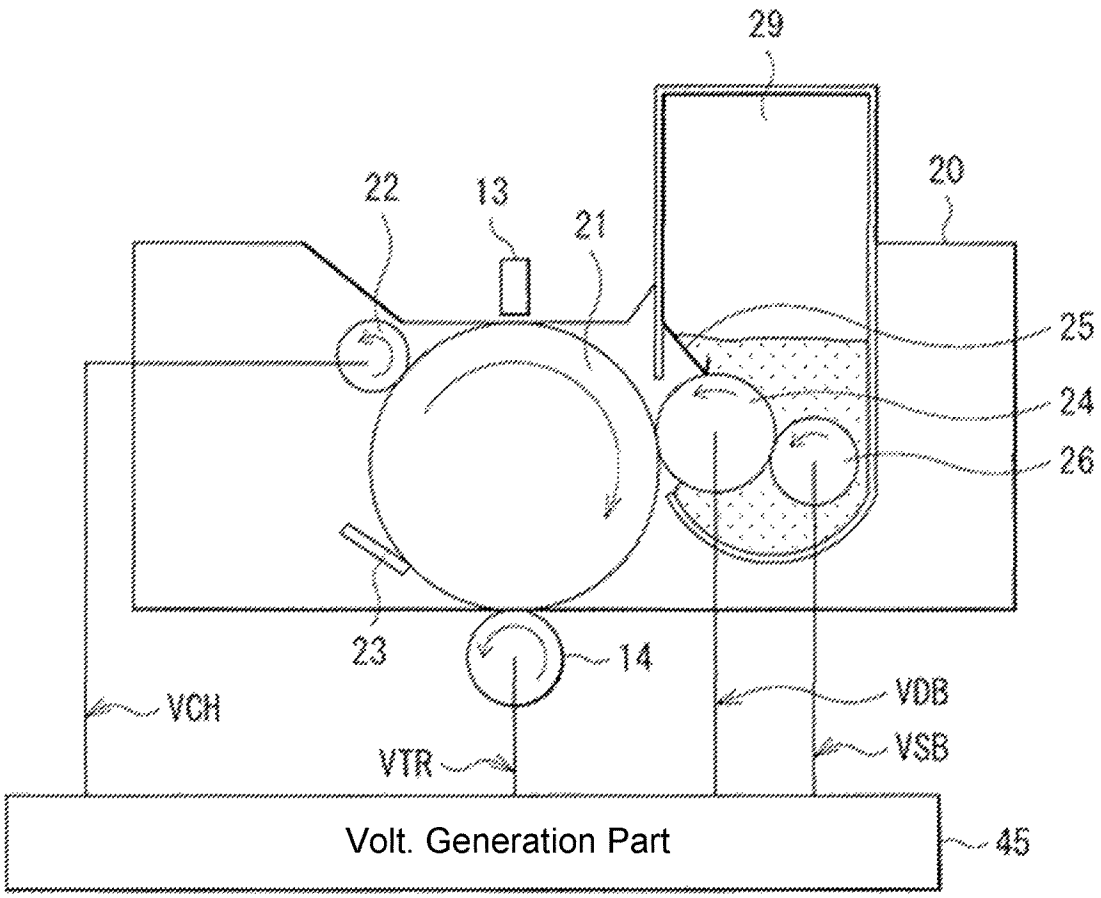
FIG. 2 is a explanatory diagram illustrating a configuration example of an ID unit illustrated in FIG. 1.

FIG. 2 illustrates a configuration example of the ID unit 20 together with a peripheral part of the ID unit 20. The ID unit 20 has a photosensitive drum 21, a charging roller 22, a cleaning blade 23, a development roller 24, a development blade 25, and a supply roller 26.

The photosensitive drum 21 is a member that carries an electrostatic latent image on a surface (surface-layer portion) thereof. The photosensitive drum 21, for example, is configured to include a conductive supporting body and a photoconductive layer. The conductive supporting body, for example, is a cylindrical member made of aluminum. The photoconductive layer is an organic photosensitive body that is formed by sequentially laminating a charge generation layer and a charge transportation layer. The photosensitive drum 21 rotates clockwise in this example due to power transmitted from a drum motor (not illustrated in the drawings). The photosensitive drum 21 is charged by the charging roller 22 and is exposed by the exposure head 13. As a result, an electrostatic latent image is formed on the surface of the photosensitive drum 21. Then, toner is supplied by the development roller 24 and thereby, a toner image corresponding to the electrostatic latent image is formed on the photosensitive drum 21.

The charging roller 22 is a member that charges the surface (surface-layer portion) of the photosensitive drum 21. The charging roller 22, for example, is formed to include a metal shaft and a semiconductive rubber layer. The charging roller 22 is arranged so as to be in contact with the surface (circumferential surface) of the photosensitive drum 21 and is arranged so as to press against the photosensitive drum 21 with a predetermined pressing amount. The charging roller 22 rotates counterclockwise in this example in response to the rotation of the photosensitive drum 21. A charging voltage VCH is applied to the charging roller 22 by a voltage generation part 45.

The cleaning blade 23 is a member that performs cleaning by scraping off toner remained on the surface (surface-layer portion) of the photosensitive drum 21. The cleaning blade 23 is arranged so as to be in contact with the surface of the photosensitive drum 21 in a state in which the cleaning blade 23 projects in a direction opposite to the rotation direction of the photosensitive drum 21, and is arranged so as to press against the photosensitive drum 21 with a predetermined pressing amount.

The development roller 24 is a member that carries toner on a surface thereof. Similar to the charging roller 22, the development roller 24, for example, is formed to include a metal shaft and a semiconductive rubber layer. The development roller 24 is arranged so as to be in contact with the surface (circumferential surface) of the photosensitive drum 21 and is arranged so as to press against the photosensitive drum 21 with a predetermined pressing amount. The development roller 24 rotates counterclockwise in this example due to power transmitted from the drum motor (not illustrated in the drawings). A development voltage VDB is applied to the development roller 24 by the voltage generation part 45.

The development blade 25 is a member that, by being in contact with a surface of the development roller 24, forms a layer (toner layer) of toner on the surface of the development roller 24 and regulates (controls and adjusts) a thickness of the toner layer. The development blade 25, for example, is formed by bending a plate-like elastic member made of stainless steel or the like in an L shape. The development blade 25 is arranged such that the bent portion of the development blade 25 is in contact with the surface of the development roller 24 and is arranged so as to press against the development roller 24 with a predetermined pressing amount.

The supply roller 26 is a member that supplies toner stored in a toner container 29 to the development roller 24. The supply roller 26, for example, is formed to include a metal shaft and a urethane foam or a silicone foam or the like. The supply roller 26 is arranged so as to be in contact with the surface (circumferential surface) of the development roller 24 and is arranged so as to press against the development roller 24 with a predetermined pressing amount. The supply roller 26 rotates counterclockwise in this example due to power transmitted from the drum motor (not illustrated in the drawings). As a result, in the ID unit 20, friction occurs between the surface of the supply roller 26 and the surface of the development roller 24. As a result, in the ID unit 20, toner is charged due to so-called frictional charging. A supply voltage VSB is applied to the supply roller 26 by the voltage generation part 45.

The exposure head 13 is a member that irradiates light to the photosensitive drum 21 of the ID unit 20. Specifically, the exposure head 13 has a plurality of LEDs (Light Emitting Diodes) arranged in a main scanning line direction, and irradiates light to the photosensitive drum 21 in dot units using light emitted from the LEDs. As a result, the photosensitive drum 21 is exposed by the exposure head 13, and an electrostatic latent image is formed on the surface of the photosensitive drum 21. In this example, light emitted from the LEDs is used to expose the photosensitive drum 21. However, the present invention is not limited to this. Instead of this, for example, it is also possible to use laser to expose the photosensitive drum 21.

The transfer roller 14 is a member that transfers a toner image formed on the photosensitive drum 21 to the print medium 9 or the transfer belt 15. Similar to the charging roller 22, the transfer roller 14, for example, is formed to include a metal shaft and a semiconductive rubber layer. The transfer roller 14 is arranged opposing the photosensitive drum 21 across the carrying path 10. A transfer voltage VTR is applied to the transfer roller 14 by the voltage generation part 45.

The transfer belt 15 (FIG. 1) carries a print medium 9 along the carrying path 10. Further, as will be described later, the transfer belt 15 also functions as a toner transferred object. The transfer belt 15, for example, is formed to include a base material, an elastic layer, and a protective layer. The base material, for example, is formed to include a polyimide resin, a polyvinylidene fluoride (PVDF) resin, a urethane resin, or the like. The elastic layer is formed on the base material and, for example, is formed of a low-hardness material. The protective layer is coated on the elastic layer and, for example, is formed to include a fluorine resin or a Teflon (registered trademark) resin, or the like. The transfer belt 15 is stretched by the drive roller 16 and the driven roller 17. The transfer belt 15 cyclically rotates in a carrying direction F in response to the rotation of the drive roller 16.

The drive roller 16 causes the transfer belt 15 to cyclically rotate. In this example, the drive roller 16 is arranged on a downstream side of the ID unit 20 in the carrying direction F, and rotates counterclockwise in this example due to power transmitted from a belt motor (not illustrated in the drawings). As a result, the drive roller 16 causes the transfer belt 15 to cyclically rotate in the carrying direction F.

The driven roller 17 is driven to rotate counterclockwise in this example in response to the cyclic rotation of the transfer belt 15. In this example, the driven roller 17 is arranged on an upstream side of the ID unit 20 in the carrying direction F.

The cleaning blade 18A is a member that performs cleaning by scraping off toner attached to a transferred surface of the transfer belt 15. The toner scraped off is accommodated in the cleaner container 18B.

The fuser 30 is a member that fuses a toner image on a print medium 9 by applying heat and pressure to the print medium 9, the toner image having been transferred onto the print medium 9. The ejection roller 19 is a pair of rollers that are arranged opposing each other across the carrying path 10, and is a member that ejects a print medium 9 on which an image has been formed.

According to this configuration, in the image forming apparatus 1, a print medium 9 fed from the medium cassette 11 is carried along the carrying path 10 and is guided to the ID unit 20, and a toner image is transferred to the print medium 9 by the transfer roller 14. Then, in the image forming apparatus 1, the print medium 9 on which a toner image is fused by the fuser 30 is ejected. In this way, the image forming apparatus 1 performs printing on the print medium 9.

Figure 3:
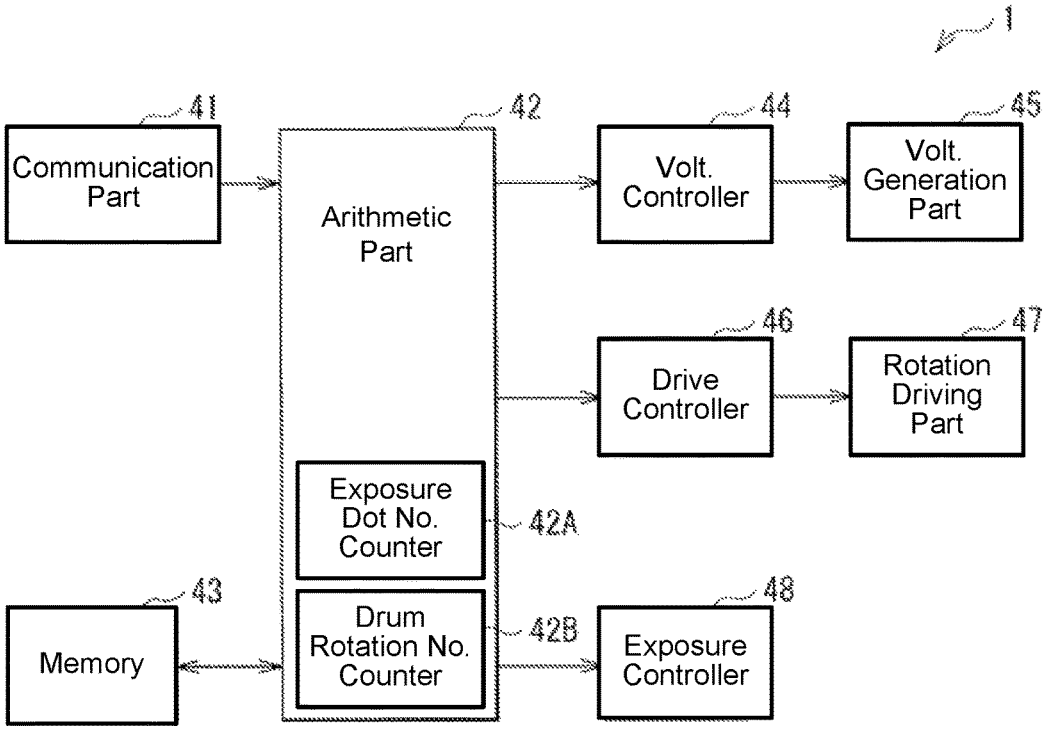
FIG. 3 is a block diagram illustrating an example of a control mechanism of an image forming apparatus according to a first embodiment.

FIG. 3 illustrates an example of a control mechanism of the image forming apparatus 1. The image forming apparatus 1 has a communication part 41, an arithmetic part 42, a memory 43, a voltage controller 44, the voltage generation part 45, a drive controller 46, a rotation driving part 47, and an exposure controller 48. A processor may be used for one of these parts.

The communication part 41 receives print data from a host PC (Personal Computer). The communication part 41, for example, may be connected to the host PC using a USB (Universal Serial Bus), or may be connected to the host PC via a LAN (Local Area Network).

The arithmetic part 42 performs a predetermined arithmetic operation based on the print data supplied from the host PC via the communication part 41 and issues instructions to the voltage controller 44, the drive controller 46 and the exposure controller 48. The arithmetic part 42, for example, is formed using a microprocessor or the like.

The arithmetic part 42 has an exposure dot number counter 42A and a drum rotation number counter 42B. The exposure dot number counter 42A determines a cumulative exposure dot number Cdot by counting an exposure amount in dot units by the exposure head 13 base on the print data. The drum rotation number counter 42B determines a cumulative drum rotation number Crot by counting a rotation number of the photosensitive drum 21 based on the print data. The arithmetic part 42 determines whether or not a print operation in which less toner is used continues, based on the cumulative exposure dot number Cdot and the cumulative drum rotation number Crot. When such a print operation continues, the arithmetic part 42 controls the image forming apparatus 1 so as to discard toner by forming a toner image having a predetermined pattern (toner discarding pattern PAT). The image forming apparatus 1 performs such a toner discarding operation, for example, during a time period after the print data is received and until a print medium 9 taken out from the medium cassette 11 arrives at the ID unit 20.

Figure 4:
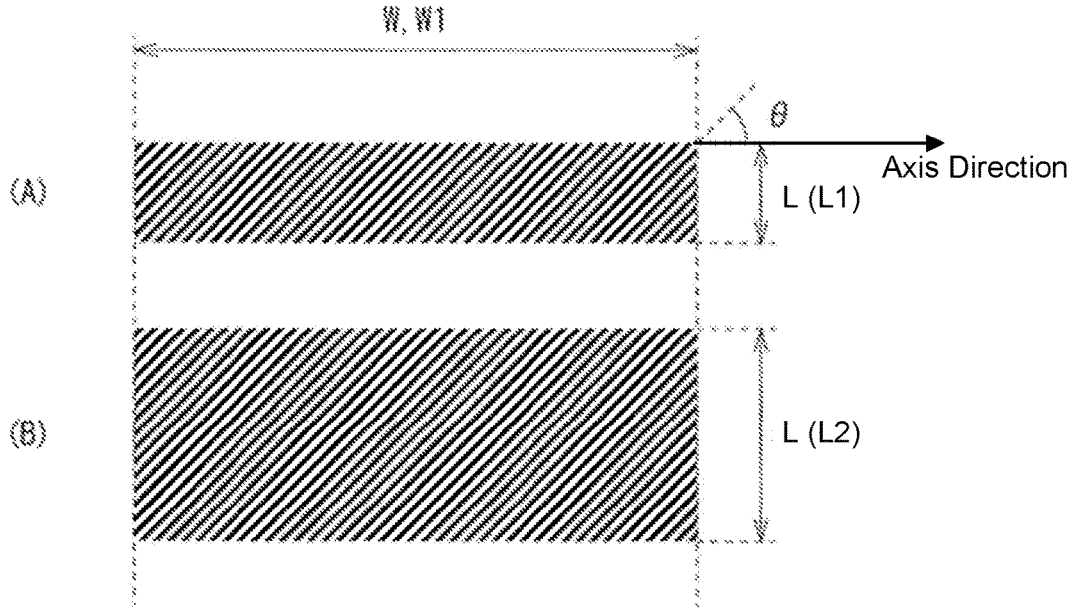
FIG. 4 is an explanatory diagram illustrating examples of toner discarding patterns.

FIG. 4 illustrates examples (A) and (B) of toner images that are used in toner discarding operations. (A) of FIG. 4 illustrates a case where less toner is discarded. (B) of FIG. 4 illustrates a case where more toner is discarded. In each of (A) and (B) of FIG. 4, a horizontal axis indicates an axial direction of the photosensitive drum 21 and a vertical axis indicates a circumferential direction of the photosensitive drum 21. Further, a black band portion indicates a portion where toner is attached and a white band portion indicates a portion where toner is not attached. In this example, the toner discarding pattern PAT is a band pattern in which band portions where toner is attached and band portions where toner is not attached are alternately arranged. A extension direction of each of the band portions is inclined at an angle θ from the axial direction of the photosensitive drum 21.

Figure 7:
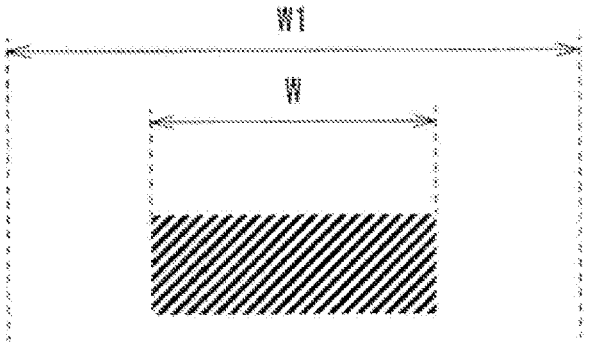
FIG. 7 is an explanatory diagram illustrating an example of a toner discarding pattern according to a modified embodiment.
Figure 8A:
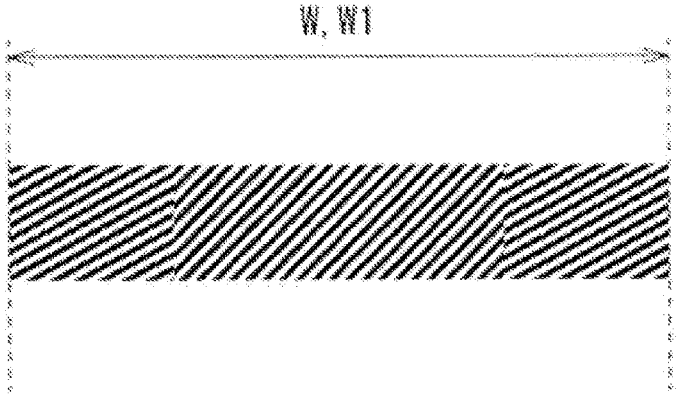
FIG. 8A is an explanatory diagram illustrating an example of a toner discarding pattern according to another modified embodiment.
Figure 8B:
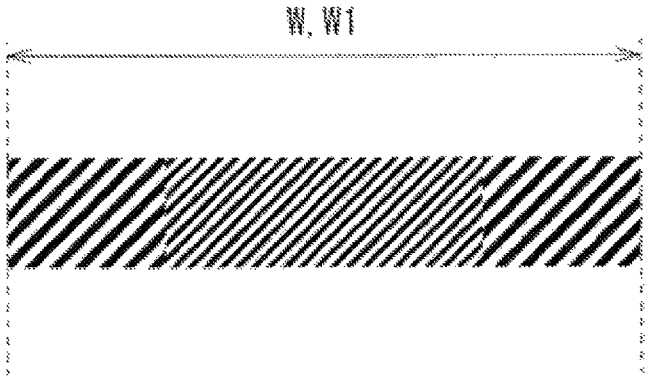
FIG. 8B is an explanatory diagram illustrating an example of a toner discarding pattern according to yet another modified embodiment.

A width W of a toner image that is used in a toner discarding operation corresponds to a range W1 (or formable range), in which a toner image can be formed, in the axial direction of the photosensitive drum 21, see FIGS. 7, 8A and 8B. That is, in this example, the image forming apparatus 1 generates a toner discarding pattern PAT over the range W1, in which a toner image can be formed, in the axial direction of the photosensitive drum 21. Further, as illustrated in (A) and (B) of FIG. 4, the image forming apparatus 1 adjusts a length L of the toner image according to an amount of toner to be discarded. That is, the image forming apparatus 1 can adjust a toner discarding amount by adjusting a time period during which the toner discarding pattern PAT is generated. In (A) of FIG. 4, the length is denoted with L1, in (B), the length is denoted with L2.

Figure 11:
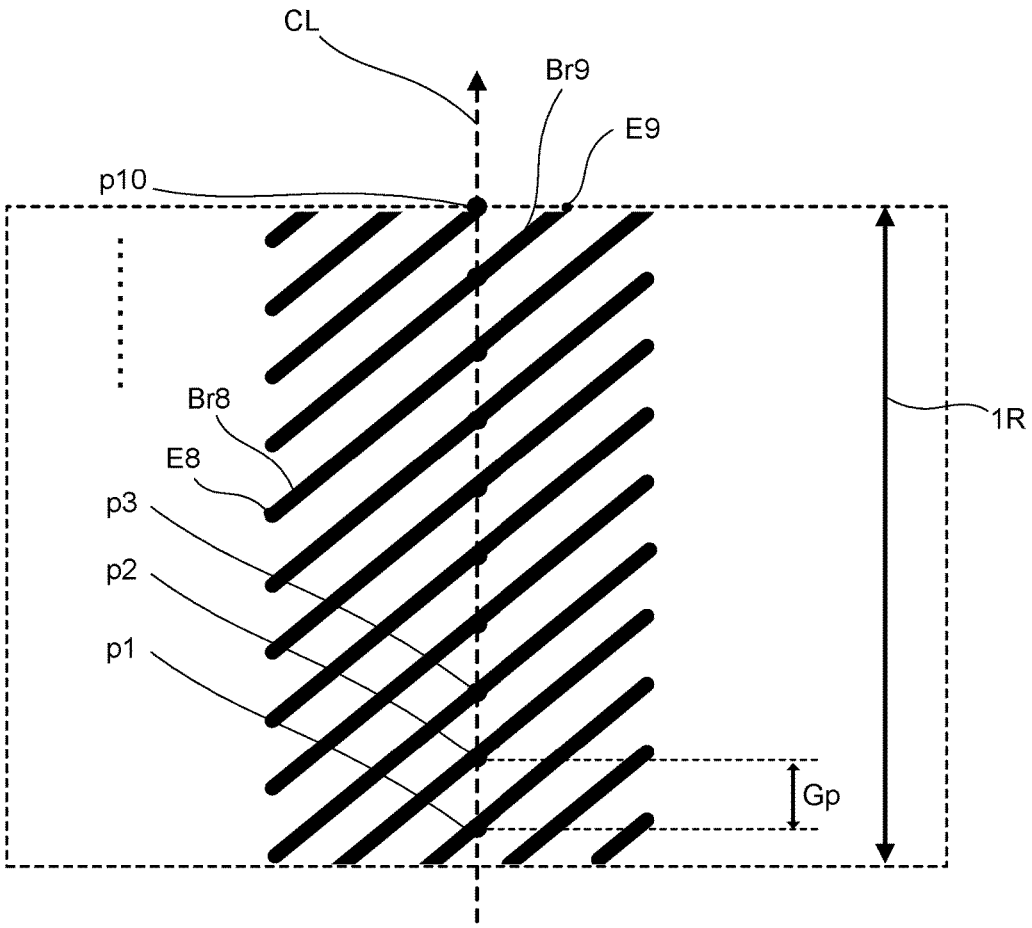
FIG. 11 illustrates an example of how many bands are included in one roll length.

The arrangement of the toner discarding bands is further illustrated in FIG. 11. The drawing is an expanded chart of the circumference of the development roller on which the toner discarding bands are disposed. The vertical length 1R means a length of one roll circumference of the development roller. When the radius of the roller is "r," the length 1R is represented by 2πr. The dotted arrow CL heading upward is an imaginary line that corresponds to a narrow circumference of the development roller. In the invention, the arrow CL must be crossed by at least one toner band otherwise old toner near the section would not be discarded. Accordingly, considering two adjacent toner bands, the right edge of the one band and the left edge of the other band must be positioned opposite side each other with respect to the arrow. In FIG. 11, the ninth band Br9 and eighth band Br8 are arranged side by side. Edge E9 of the band Br9 is right from the arrow CL and edge E8 of the band Br8 is left. Further, considering of the number of toner bands that cross the arrow CL, 10 to 20 of the toner bands are preferred. In FIG. 11, 10 of toner bars are shown. The crossing points with the arrow CL are shown with large dots denoted from p1 to p10 from the bottom to the top. When these toner bands are contiguously formed while the development roller rotates and these crossing points are formed on the similar spots, areas where the toner band exist can discard old toner, but other area where the toner bands do not exist cannot discard old toner. Accordingly, it is preferred that the crossing points moves back and forth every time the development roller makes one rotation. In order to realize such a structure, the length 1R of the development roller should not be divisible by gap Gp between two adjacent toner bands in the vertical direction (or main scanning line direction). As a simple example, when length 1R is 10 inches, gap Gp should not be 1 inch, 2, or 5 inches because 10 is divisible with respect to those numbers. The gap need to be 3 or 4 inches. Especially, when the remainder of the division is close to half of the gap, that is more preferable.

In the image forming apparatus 1, in the case where a print operation in which less toner is used continues, for example, during a time period until a print medium 9 taken out from the medium cassette 11 arrives at the ID unit 20, a toner image having such a toner discarding pattern PAT is formed on the photosensitive drum 21, and the toner image is transferred to the transfer belt 15. Then, the cleaning blade 18A scrapes off the toner attached to a transferred surface of the transfer belt 15 and thereby, the toner is discarded. The present invention is not limited to this. For example, it is also possible that, in a toner discarding operation, a transfer voltage VTR is not applied to the transfer roller 14, and the cleaning blade 23 of the ID unit 20 scrapes off the toner remaining on the photosensitive drum 21, and thereby, the toner is discarded. In this way, in the image forming apparatus 1, in the case where a print operation in which less toner is used continues, toner of which the potential rises more than necessary due to frictional charging for a long time period is discarded.

In this example, the toner image having the toner discarding pattern PAT is formed on the photosensitive drum 21 during the time period after the print data is received and until the print medium 9 taken out from the medium cassette 11 arrives at the ID unit 20. However, the present invention is not limited to this. The time period may be any time period as long as the time period is other than a time period during which the ID unit 20 forms a toner image corresponding to the print data. Specifically, for example, it is possible that a toner image having the toner discarding pattern PAT is formed on the photosensitive drum 21 during a time period after the ID unit 20 transfers toner to a print medium 9 and until the print medium 9 is ejected.

The memory 43 stores a sequence control program of a print operation, various kinds of data, setting values and the like, and is formed, for example, using a semiconductor memory such as a ROM (Read Only Memory) or a RAM (Random Access Memory).

The voltage controller 44 instructs the voltage generation part 45 regarding values of voltages supplied to various rollers and the like of the image forming apparatus 1 and regarding on-off of voltage output from the voltage generation part 45. The voltage generation part 45 generates voltages that are supplied to the various rollers and the like of the image forming apparatus 1 based on instructions from the voltage controller 44.

The drive controller 46 instructs the rotation driving part 47 regarding on-off of rotation operations of the various motors of the image forming apparatus 1. The rotation driving part 47 is configured to include various motors, gears, and the like, and operates based on an instruction from the drive controller 46.

The exposure controller 48 controls a light emitting operation of each of the LEDs of the exposure head 13.

Here, the photosensitive drum 21 corresponds to a specific example of a "first image carrier" of the present invention. The exposure head 13 corresponds to a specific example of a "first exposure part" of the present invention. The development roller 24 corresponds to a specific example of a "first development part" of the present invention. The toner corresponds to a specific example of a "first developer" of the present invention. The toner discarding pattern PAT corresponds to a specific example of a "first band pattern" of the present invention. The angle θ corresponds to a specific example of an "inclination angle" of the present invention. The arithmetic part 42 corresponds to a specific example of a "controller" of the present invention. The cleaning blades 23, 18A are each a specific example of a "developer removing member" of the present invention.

[Operation and Effect ]

Next, operation and effect of the image forming apparatus 1 of the present embodiment is described.

(Overall Operation Overview)

First, with reference to FIGS. 1-3, an overall operation overview of the image forming apparatus 1 is described. The arithmetic part 42 (FIG. 3) of the image forming apparatus 1 controls the operations of the members such as the ID unit 20, the exposure head 13, the fuser 30, and the various rollers based on the print data. In doing so, the arithmetic part 42 determines whether or not a print operation in which less toner is used continues, based on the cumulative exposure dot number Cdot and the cumulative drum rotation number Crot. Then, in the case where such a print operation continues, the arithmetic part 42 controls the image forming apparatus 1 to form a toner image having the toner discarding pattern PAT, for example, during a time period until a print medium 9 taken out from the medium cassette 11 arrives at the ID unit 20. As a result, the exposure head 13 and the ID unit 20 forms the toner image and the transfer roller 14 transfers the toner image to the transfer belt 15. Then, for example, the cleaning blade 18A scrapes off the toner attached to the transferred surface of the transfer belt 15. In this way, the image forming apparatus 1 discards the toner.

Thereafter, the arithmetic part 42 controls the image forming apparatus 1 to form a toner image corresponding to the print data, and the exposure head 13 and the ID unit 20 forms the toner image. Then, the transfer roller 14 transfers the toner image formed by the ID unit 20 onto the print medium 9, and the fuser 30 fuses the toner image on the print medium 9. In this way, the image forming apparatus 1 prints an image on a print medium 9.

(Detailed Operation)

Next, a toner discarding operation of the image forming apparatus 1 is described.

Figure 5:
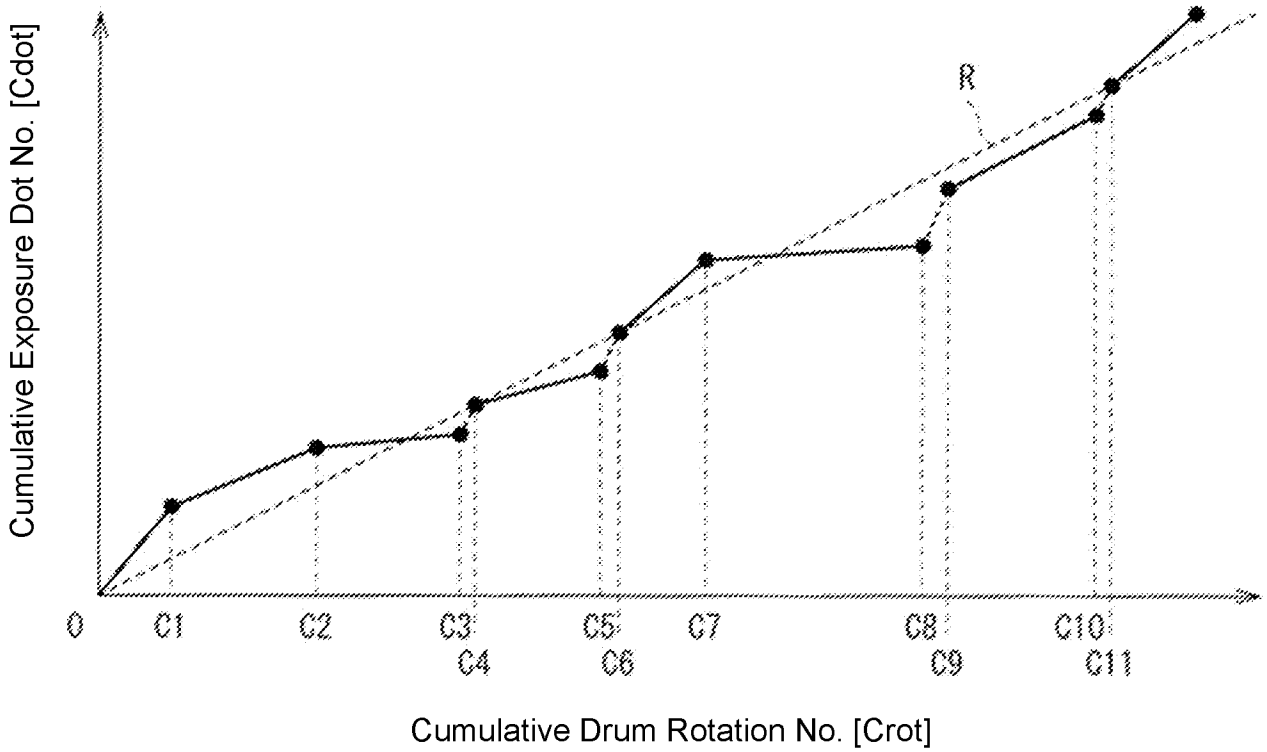
FIG. 5 is an explanatory diagram illustrating an operation example of the image forming apparatus according to the first embodiment.

FIG. 5 illustrates an operation example of the image forming apparatus 1. The arithmetic part 42 of the image forming apparatus 1 determines whether or not a print operation in which less toner is used continues based on the cumulative exposure dot number Cdot and the cumulative drum rotation number Crot. In doing so, the arithmetic part 42 determines whether or not a print operation in which less toner is used continues based on a reference characteristic R illustrated in FIG. 5. The reference characteristic R in this example is a characteristic in which the cumulative exposure dot number Cdot linearly increases with an increase in the cumulative drum rotation number Crot. The arithmetic part 42 compares the cumulative exposure dot number Cdot with a value of the reference characteristic R (reference value), and based on a result of the comparison, determines whether or not a print operation in which less toner is used continues. Then, the arithmetic part 42 controls the image forming apparatus 1 so as to discard toner by forming a toner image having the toner discarding pattern PAT. In the following, this operation is described in detail.

First, the image forming apparatus 1 receives the print data supplied from the host PC. In the arithmetic part 42, the exposure dot number counter 42A updates the cumulative exposure dot number Cdot based on the print data, and the drum rotation number counter 42B updates the cumulative drum rotation number Crot based on the print data. As a result, the value of the cumulative drum rotation number Crot becomes a value C1. In this case, the cumulative exposure dot number Cdot is larger than the value of the reference characteristic R (reference value) when the value of the cumulative drum rotation number Crot is the value Cl. Therefore, the arithmetic part 42 determines that it is not a print operation in which less toner is used, and the image forming apparatus 1 performs printing on a print medium 9 based on the print data without performing a toner discarding operation.

Next, the image forming apparatus 1 receives the next print data from the host PC and thereby, the value of the cumulative drum rotation number Crot becomes a value C2. In this case, the cumulative exposure dot number Cdot is larger than the value of the reference characteristic R (reference value) when the value of the cumulative drum rotation number Crot is the value C2. Therefore, the arithmetic part 42 determines that it is not a print operation in which less toner is used, and the image forming apparatus 1 performs printing on a print medium 9 based on the print data without performing a toner discarding operation.

Next, the image forming apparatus 1 receives the next print data from the host PC and thereby, the value of the cumulative drum rotation number Crot becomes a value C3. In this case, the cumulative exposure dot number Cdot is smaller than the value of the reference characteristic R (reference value) when the value of the cumulative drum rotation number Crot is the value C3. Therefore, the arithmetic part 42 determines that a print operation in which less toner is used continues, and determines that a toner discarding operation is to be performed. Then, the arithmetic part 42 determines the length L of the toner image having the toner discarding pattern PAT based on the cumulative exposure dot number Cdot and the cumulative drum rotation number Crot. Specifically, the arithmetic part 42 determines the length L such that, when the toner image of the length L is formed, a point determined by the cumulative exposure dot number Cdot and the cumulative drum rotation number Crot is on the reference characteristic R. Then, in the arithmetic part 42, the exposure dot number counter 42A updates the cumulative exposure dot number Cdot based on the toner image of such a length L, and the drum rotation number counter 42B updates the cumulative drum rotation number Crot based on the toner image of such a length L. As a result, in this example, a point determined by the cumulative exposure dot number Cdot and the cumulative drum rotation number Crot is on the reference characteristic R. In this case, the value of the cumulative drum rotation number Crot becomes a value C4. The image forming apparatus 1 discards the toner by forming the toner image of such a length L during the time period until the print medium 9 taken out from the medium cassette 11 arrives at the ID unit 20. Thereafter, the image forming apparatus 1 performs printing on the print medium 9 based on the print data.

Next, the image forming apparatus 1 receives the next print data from the host PC and thereby, the value of the cumulative drum rotation number Crot becomes a value C5. In this case, the cumulative exposure dot number Cdot is smaller than the value of the reference characteristic R (reference value) when the value of the cumulative drum rotation number Crot is the value C5. Therefore, the arithmetic part 42 determines that a print operation in which less toner is used continues, and determines that a toner discarding operation is to be performed. Then, the arithmetic part 42 determines the length L of the toner image having the toner discarding pattern PAT based on the cumulative exposure dot number Cdot and the cumulative drum rotation number Crot. Then, in the arithmetic part 42, the exposure dot number counter 42A updates the cumulative exposure dot number Cdot based on the toner image of such a length L, and the drum rotation number counter 42B updates the cumulative drum rotation number Crot based on the toner image of such a length L. As a result, the value of the cumulative drum rotation number Crot becomes a value C6. The image forming apparatus 1 discards the toner by forming the toner image of such a length L during the time period until the print medium 9 taken out from the medium cassette 11 arrives at the ID unit 20. In this example, more toner is discarded by making the length L of the toner image longer than the length of the toner image formed when the cumulative drum rotation number Crot is C3 or C4. Thereafter, the image forming apparatus 1 performs printing on the print medium 9 based on the print data.

Next, the image forming apparatus 1 receives the next print data from the host PC and thereby, the value of the cumulative drum rotation number Crot becomes a value C7. In this case, the cumulative exposure dot number Cdot is larger than the value of the reference characteristic R (reference value) when the value of the cumulative drum rotation number Crot is the value C7. Therefore, the arithmetic part 42 determines that it is not a print operation in which less toner is used, and the image forming apparatus 1 performs printing on a print medium 9 based on the print data without performing a toner discarding operation.

Next, the image forming apparatus 1 receives the next print data from the host PC and thereby, the value of the cumulative drum rotation number Crot becomes a value C8. In this case, the cumulative exposure dot number Cdot is smaller than the value of the reference characteristic R (reference value) when the value of the cumulative drum rotation number Crot is the value C8. Therefore, the arithmetic part 42 determines that a print operation in which less toner is used continues, and determines that a toner discarding operation is to be performed. Then, the arithmetic part 42 determines the length L of the toner image having the toner discarding pattern PAT based on the cumulative exposure dot number Cdot and the cumulative drum rotation number Crot. In this example, the determined length L of the toner image is longer than an upper limit (length Lmax) of the length of a toner image that can be formed during the time period until a print medium 9 taken out from the medium cassette 11 arrives at the ID unit 20. Therefore, in the arithmetic part 42, the exposure dot number counter 42A updates the cumulative exposure dot number Cdot based on the toner image of the length Lmax, and the drum rotation number counter 42B updates the cumulative drum rotation number Crot based on the toner image of the length Lmax. As a result, the value of the cumulative drum rotation number Crot becomes a value C9. As a result, in this example, the length of the toner image is shorter than the desired length. Therefore, a point determined by the cumulative exposure dot number Cdot and the cumulative drum rotation number Crot is not on the reference characteristic R. The image forming apparatus 1 discards the toner by forming the toner image of such a length Lmax during the time period until the print medium 9 taken out from the medium cassette 11 arrives at the ID unit 20. Thereafter, the image forming apparatus 1 performs printing on the print medium 9 based on the print data.

Next, the image forming apparatus 1 receives the next print data from the host PC and thereby, the value of the cumulative drum rotation number Crot becomes a value C10. In this case, the cumulative exposure dot number Cdot is smaller than the value of the reference characteristic R (reference value) when the value of the cumulative drum rotation number Crot is the value C10. Therefore, the arithmetic part 42 determines that a print operation in which less toner is used continues, and determines that a toner discarding operation is to be performed. Then, the arithmetic part 42 determines the length L of the toner image having the toner discarding pattern PAT based on the cumulative exposure dot number Cdot and the cumulative drum rotation number Crot. In this example, the determined length L of the toner image is shorter than the upper limit (length Lmax) of the length of a toner image that can be formed during the time period until a print medium 9 taken out from the medium cassette 11 arrives at the ID unit 20. Then, in the arithmetic part 42, the exposure dot number counter 42A updates the cumulative exposure dot number Cdot based on the toner image of such a length L, and the drum rotation number counter 42B updates the cumulative drum rotation number Crot based on the toner image of such a length L. As a result, in this example, a point determined by the cumulative exposure dot number Cdot and the cumulative drum rotation number Crot is on the reference characteristic R. In this case, the value of the cumulative drum rotation number Crot becomes a value C11. The image forming apparatus 1 discards the toner by forming the toner image of such a length L during the time period until the print medium 9 taken out from the medium cassette 11 arrives at the ID unit 20. Thereafter, the image forming apparatus 1 performs printing on the print medium 9 based on the print data.

Figure 6:
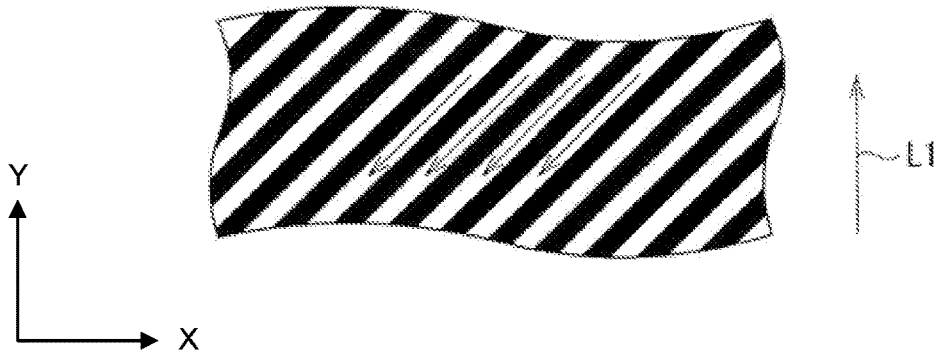
FIG. 6 is a schematic diagram illustrating a toner agitation operation in a toner discarding operation.

FIG. 6 schematically illustrates toner remaining on the surface of the development roller 24 when the ID unit 20 forms a toner image having the toner discarding pattern PAT. In FIG. 6, a horizontal axis (X) indicates an axial direction of the development roller 24 and a vertical axis (Y) indicates a circumferential direction of the development roller 24. The axial direction of the development roller 24 is substantially the same as the axial direction of the photosensitive drum 21. An arrow L1 indicates a rotation direction of the development roller 24. Further, a white band portion indicates a portion where less toner remains due to that the development roller 24 supplies toner to the photosensitive drum 21, and a black band portion indicates a portion where more toner remains. That is, the pattern of the remaining toner corresponds to the toner discarding pattern PAT.

As illustrated in FIG. 6, after the toner of the development roller 24 is consumed, the supply roller 26 supplies toner to the development roller 24 by frictional charging. In this case, as illustrated by arrows in FIG. 6, the toner is attached to the development roller 24 while moving on the surface of the development roller 24 along the band portions where less toner remains. That is, the toner is attached to the development roller 24 while being agitated not only in the circumferential direction of the development roller 24 (longitudinal direction in FIG. 6) but also in the axial direction of the development roller 24 (lateral direction in FIG. 6). As a result, in the image forming apparatus 1, unevenness (bias) of the potential of the toner in the axial direction can be suppressed and image quality can be improved. Through the disclosure of the application, a term "agitated" means "to be repeatedly placed with an interval. In the above content, it is explained that the toner is to be repeatedly attached on multiple spots of a surface of the development roller 24, the spots being separated with an interval.

That is, when a toner discarding operation is performed, for example, when a toner image of a uniform toner density is used instead of a toner image having the toner discarding pattern PAT, the toner is agitated in the circumferential direction of the development roller 24 but is unlikely to be agitated in the axial direction of the development roller 24. Therefore, for example, as in a case of printing a table, toner at a predetermined position in the axial direction of the photosensitive drum 21 is mainly consumed and thereby, even when unevenness of the potential of the toner occurs in the axial direction of the development roller 24, the toner is unlikely to be agitated in the axial direction of the development roller 24 and thus, the unevenness of the potential of the toner is unlikely to be eliminated. In this way, when unevenness of the potential of the toner occurs in the axial direction of the development roller 24, for example, toner having more than necessarily high potential is likely to be attached to the photosensitive drum 21. Therefore, there is a risk that the print medium 9 is contaminated and image quality is reduced.

On the other hand, in the image forming apparatus 1, the toner image having the toner discarding pattern PAT is used. Therefore, the toner can be agitated not only in the circumferential direction of the development roller 24 (longitudinal direction in FIG. 6) but also in the axial direction of the development roller 24 (lateral direction in FIG. 6). As a result, unevenness of the potential of the toner in the axial direction can be suppressed. That is, by using the toner discarding pattern PAT, in addition to the effect of discarding the toner, it is also possible to achieve an effect of suppressing unevenness of the potential of the toner. As a result, in the image forming apparatus 1, image quality can be improved.

The angle θ of the toner discarding pattern PAT, for example, can be set according to flowability of the toner that is sued. Specifically, for example, a larger angle θ is desirable when a toner having a low flowability is used, and smaller angle θ is desirable when a toner having a high flowability is used.

Figure 10:
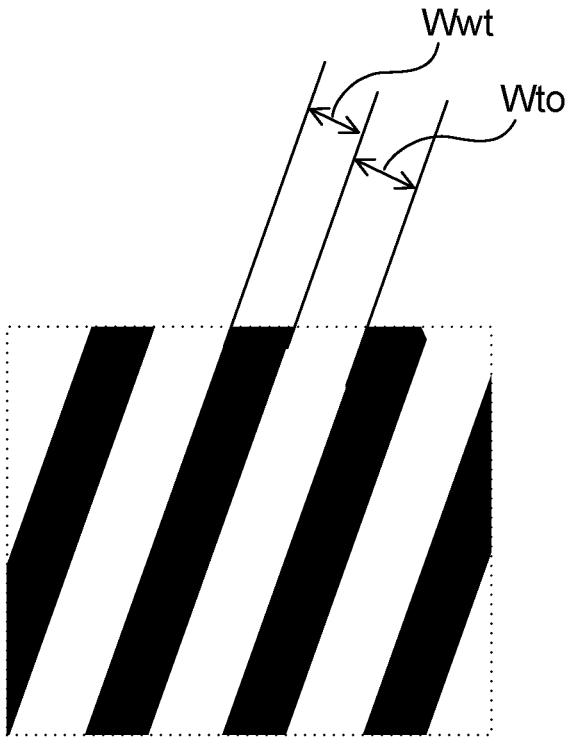
FIG. 10 illustrates an enlarged portion of a toner discarding pattern.

For example, when a finely pulverized toner having a flowability of 75-85% and a particle diameter of 5.5-6.5 μm was used, the toner discarding pattern PAT that allows the unevenness of the potential of the toner in the axial direction of the development roller 24 to be suppressed was confirmed by an experiment. In this experiment, the flowability of the toner was measured using Model PT-S manufactured by Hosokawa Micron Corporation. Further, a toner image having the toner discarding pattern PAT was formed based on the control illustrated in FIG. 5 while blank printing was continuously performed for one hour. As a result, in this example, a result was obtained that the angle θ of the toner discarding pattern PAT is desirably within a range of 60-85 degrees, and preferably within a range of 70-80 degrees. In the toner discarding pattern PAT, a width of a band portion where the toner is attached and a width of a band portion where the toner is not attached are desirably substantially equal to each other, and the widths are desirably within a range of 0.8-2.0 mm. When the width of the band portion where the toner is attached is wider than the width of the band portion where the toner is not attached, the toner discarding amount is increased and thus there is a risk that the toner consumption efficiency is deteriorated. Further, when the width of the band portion where the toner is attached is narrower than the width of the band portion where the toner is not attached, there is a risk that the toner is not sufficiently discarded and the image quality is reduced. Further, a result was obtained that, when the rotation speeds of the photosensitive drum 21 and the various rollers such as the development roller 24 are slower, the unevenness of the potential of the toner can be more suppressed. FIG. 10 illustrates the toner discarding pattern. The width of the band with toner is denoted with Wwt. The width of the band without toner is denoted with Wto. The ratio of Wwt/to may be determined in consideration of several working conditions. The ratio practically approaches around 20%.

In this way, it is desirable that the toner discarding pattern PAT be set according to the characteristics of the toner that is used, the rotation speeds of the photosensitive drum 21 and the various rollers such as the development roller 24 of the image forming apparatus 1, and the like.

[Effects ]

As described above, in the present embodiment, when the toner discarding operation is performed, the toner image having the toner discarding pattern PAT that includes the inclined band pattern is used. Therefore, the toner can be agitated not only in the circumferential direction of the development roller but also in the axial direction of the development roller. As a result, the unevenness of the potential of the toner in the axial direction of the development roller can be suppressed and thus the image quality can be improved.

[Modified Embodiment 1-1]

In the above embodiment, as illustrated in (A) and (B) of FIG. 4, the image forming apparatus 1 generates the toner discarding pattern PAT over the range W1, in which a toner image can be formed, in the axial direction of the photosensitive drum 21. However, the present invention is not limited to this. Instead of this, for example, as illustrated in FIG. 7, it is also possible that the toner discarding pattern PAT is generated over a portion of the range W1, in which a toner image can be formed, in the axial direction of the photosensitive drum 21. Specifically, for example, when unevenness of the potential of the toner is likely to occur in a portion in the axial direction of the development roller 24, it is possible that the toner discarding pattern PAT is generated only in that portion. Further, for example, it is also possible that, in the axial direction of the photosensitive drum 21, the toner discarding pattern PAT is generated only in a range corresponding to a width of the print medium 9.

[Modified Embodiment 1-2]

In the above embodiment, as illustrated in (A) and (B) of FIG. 4, the angle θ and the widths of the band portions of the toner discarding pattern PAT are the same over the range W1, in which a toner image can be formed, in the axial direction of the photosensitive drum 21. However, the present invention is not limited to this. As illustrated in FIGS. 8A and 8B, it is also possible that the angle θ and the widths of the band portions are varied in the axial direction of the photosensitive drum 21.

[Modified Embodiment 1-3]

In the above embodiment, the cumulative drum rotation number Crot is used to determine a toner discharging timing or to determine a toner discharging pattern. However, the present invention is not limited to this. Instead of this, for example, it is also possible that the number of printed print media 9 (cumulative print sheet number) is used. Any type of information, or indicators that indicate a usage degree of the photosensitive drum can be available for the invention. For example, accumulated printing time, amount length of regular printing may be useful to determine when old toner is discarded.

<2. Second Embodiment>

Next, an image forming apparatus 2 according to a second embodiment is described. The present embodiment is configured such that the toner discarding pattern PAT can be dynamically changed. A configuration component that is substantially the same as in the image forming apparatus 1 according to the above first embodiment is indicated using the reference numeral symbol, and description thereof is omitted as appropriate.

Figure 9:
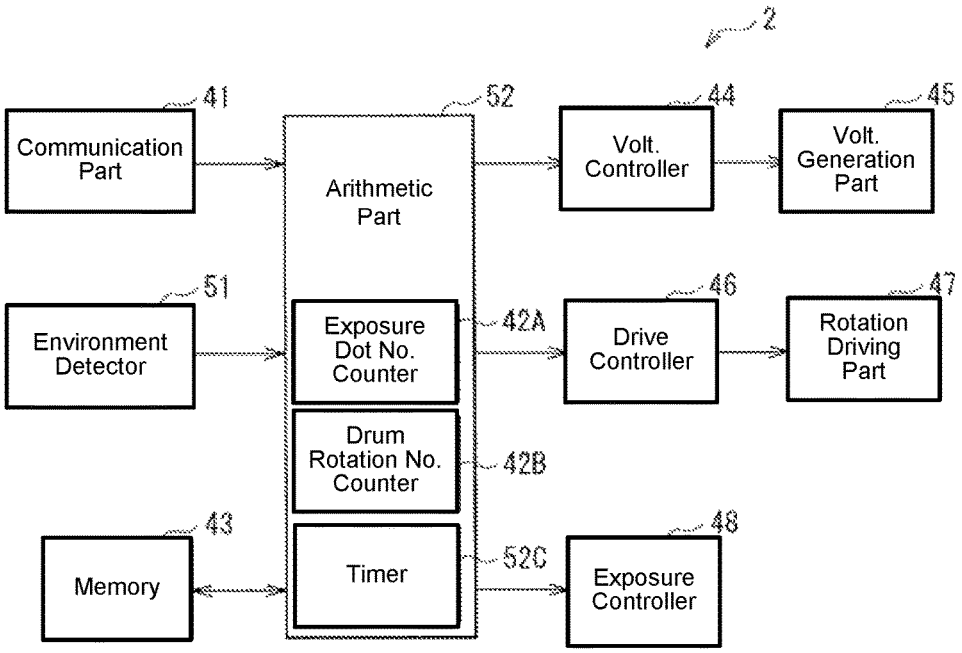
FIG. 9 is a block diagram illustrating an example of a control mechanism of an image forming apparatus according to a second embodiment.

FIG. 9 illustrates an example of a control mechanism of the image forming apparatus 2. The image forming apparatus 2 has an environment detector 51 and an arithmetic part 52.

The environment detector 51 detects a temperature and a humidity and supplies the results of the detection to the arithmetic part 52. The temperature and humidity are examples of an environmental condition. The temperature and humidity may be measured inside the image forming apparatus. However, as long as these figures indicates a working conditions with respect to an image forming unit composed with the photosensitive drum, charging roller or development roller etc., the temperature and humidity may be measured outside the apparatus. Other indicator other than temperature and humidity may be adoptable based on common acknowledgements.

The arithmetic part 52 has a timer 52C. The timer 52C measures an operation time of the image forming apparatus 2. The timer 52C is configured such that the operation time is reset each time the ID unit 20 is replaced, and can hold the value of the operation time even when a power source of the image forming apparatus 2 is turned off Similar to the image forming apparatus 1 according to the first embodiment, the image forming apparatus 2 performs a toner discarding operation in the case where a print operation in which less toner is used continues, In this case, the arithmetic part 52 changes the angle θ of the toner discarding pattern PAT according to the operation time of the image forming apparatus 2 held by the timer 52C. That is, after the ID unit 20 is replaced, as the operation time elapses, in general, the flowability of the toner decreases. This is because toner external additives are peeled off from toner mother particles or the toner external additives are embedded in the toner mother particles. Therefore, the arithmetic part 52 increases the angle θ of the toner discarding pattern PAT when the operation time is longer. As a result, in the image forming apparatus 2, even when the operation time has elapsed, unevenness of the potential of the toner in the axial direction of the development roller 24 can be suppressed and, as a result, the image quality can be improved.

Further, the arithmetic part 52 also has a function of changing the angle θ of the toner discarding pattern PAT based on the detection results of the temperature and the humidity supplied from the environment detector 51. That is, for example, when the temperature is higher, the surface of the toner becomes softer and thus the flowability of the toner decreases. Further, for example, when the humidity is higher, aggregation of toner particles is more likely to occur and thus the flowability of the toner decreases. Therefore, the arithmetic part 52 increases the angle θ of the toner discarding pattern PAT when the temperature is higher and, similarly, increases the angle θ of the toner discarding pattern PAT when the humidity is higher. As a result, in the image forming apparatus 2, even when the temperature or the humidity changes, unevenness of the potential of the toner in the axial direction of the development roller 24 can be suppressed and, as a result, the image quality can be improved.

Further, the arithmetic part 52 has a function of increasing the toner discarding amount when the angle θ of the toner discarding pattern PAT becomes larger. That is, when the angle θ of the toner discarding pattern PAT is large, there is a risk that the agitation effect in the axial direction of the development roller 24 is decreased. Therefore, when the angle θ of the toner discarding pattern PAT becomes larger, the arithmetic part 52 increases the toner discarding amount, for example, by increasing the length L of the toner image. As a result, in the image forming apparatus 2, even when the angle θ of the toner discarding pattern PAT becomes large, unevenness of the potential of the toner in the axial direction of the development roller 24 can be suppressed and, as a result, the image quality can be improved.

As described above, in the present embodiment, when the toner discarding operation is performed, the toner discarding pattern can be dynamically changed. Therefore, even when the flowability of toner has changed due to the elapse of the operation time or the change in the temperature and the humidity, unevenness of the potential of the toner in the axial direction of the development roller can be suppressed and, as a result, the image quality can be improved. Such a toner discarding pattern discussed in the second embodiment may be called a "changeable pattern." On the other hand, like discussed in the first embodiment, when a single toner discarding pattern has been arranged regardless of conditions, the pattern may be called a "fixed pattern."

[Modified Embodiment 2]

The modified embodiments of the first embodiment are also applicable to the image forming apparatus 2 of the second embodiment.

In the above, the present invention is described by illustrating the embodiments and the modified embodiments.

However, the present invention is not limited to these embodiments and the like, and various modifications are possible.

For example, in the above embodiments and the like, the image forming apparatus 1 is configured such that the one exposure head 13 and the one ID unit 20 are provided and a black-and-white image can be formed. However, the present invention is not limited to this. Instead of this, for example, it is also possible that the image forming apparatus 1 is configured such that a plurality of exposure heads 13 and a plurality of ID units 20 are provided and a color image can be formed. In this case, angles θ of toner discarding patterns PAT that are respectively formed by the ID units 20 may be respectively set according to flowabilities of toners that are respectively used by the ID units 20.

Further, for example, in the above embodiments and the like, the ID unit 20 and the toner container 29 are integrally formed. However, the present invention is not limited to this. Instead of this, for example, it is also possible that a portion of the toner container 29 is configured as a so-called toner cartridge that is detachably attached to the ID unit 20.

Further, for example, in the above embodiments and the like, the present invention is applied to a printer. However, the present invention is not limited to this. Instead of this, for example, the present invention may also be applied to a FAX machine or a photocopy apparatus. Further, for example, the present invention may also be applied to a multifunction peripheral that has functions of a printer, a FAX, a scanner and the like.

What is claimed is:

1. An image forming apparatus, comprising:

a first image carrier;

a first exposure part that forms a first electrostatic latent image in dot units on the first image carrier;

a first development part that develops the first electrostatic latent image of the first image carrier using a first developer; and a controller that forms an inclined first band pattern of which bands incline with respect to a main scanning line direction on the first image carrier with the first exposure part and the first development part, wherein the controller is configured to vary the first band pattern, the first image carrier rotates about a rotation axis, and the controller varies the first band pattern according to an operation time and by changing an inclination angle of the first band pattern, the inclination angle being determined with respect to the rotation axis.

2. The image forming apparatus according to claim 1, wherein a development amount of the first developer to be used becomes larger as the inclination angle of the first band pattern increases.

3. The image forming apparatus according to claim 1, wherein the inclination angle varies according to flowability of the first developer used, and the inclination angle is greater when the first developer has lower flowability than when the first developer has higher flowability.

4. The image forming apparatus according to claim 1, wherein the inclination angle is in a range from 60 to 85 degrees.

5. The image forming apparatus according to claim 1, wherein the inclination angle is in a range from 70 to 80 degrees.

6. The image forming apparatus according to claim 1, wherein the controller determines a first cumulative exposure dot number in the first exposure part based on print data, the first cumulative exposure dot number being determined as a cumulative dot number used by the first development part since the first development part starts developing the first electrostatic latent image, and the operation time is determined based on the first cumulative exposure dot number.

7. An image forming apparatus, comprising:

a first image carrier;

a first exposure part that forms a first electrostatic latent image in dot units on the first image carrier;

a first development part that develops the first electrostatic latent image of the first image carrier using a first developer; and a controller that forms an inclined first band pattern of which bands incline with respect to a main scanning line direction on the first image carrier with the first exposure part and the first development part, wherein the first image carrier rotates about a rotation axis, the first band pattern is formed in a first region corresponding to a first range within a formable range, and the first developer image has a second band pattern that is different from the first band pattern and is formed in a second region corresponding to a second range that is different from the formable range.

8. The image forming apparatus according to claim 7, wherein the first band pattern and the second band pattern have different inclination angles.

9. The image forming apparatus according to claim 7, wherein the first band pattern and the second band pattern have different widths in band portions thereof.

10. An image forming apparatus, comprising:

a first image carrier;

a first exposure part that forms a first electrostatic latent image in dot units on the first image carrier;

a first development part that develops the first electrostatic latent image of the first image carrier using a first developer; and a controller that forms an inclined first band pattern of which bands incline with respect to a main scanning line direction on the first image carrier with the first exposure part and the first development part, wherein the controller determines a first cumulative exposure dot number in the first exposure part based on print data, the first cumulative exposure dot number being determined as a cumulative dot number used by the first development part since the first development part starts developing the first electrostatic latent image, and determines whether or not to form a first developer image having the first band pattern based on the first cumulative exposure dot number, and the controller determines to form the first band pattern when the first cumulative exposure dot number is smaller than a target exposure dot number.

11. The image forming apparatus according to claim 10, wherein the first band pattern is a fixed pattern.

12. The image forming apparatus according to claim 10, wherein the controller is configured to vary the first band pattern according to an operation time.

13. The image forming apparatus according to claim 10, further comprising:

an environment detector that detects an environmental condition, wherein the controller varies the first band pattern according to the environmental condition.

14. The image forming apparatus according to claim 10, wherein the first image carrier rotates about a rotation axis, and the first band pattern is formed in a first region corresponding to a first range within a formable range in which a developer image can be formed on the first image carrier in an axial direction of the rotation axis or in a second region corresponding to a second range within the formable range.

15. The image forming apparatus according to claim 10, wherein the first image carrier rotates about a rotation axis, and the controller determines a cumulative rotation number of the first image carrier based on the print data and determines the target exposure dot number based on the cumulative rotation number.

16. The image forming apparatus according to claim 10, wherein the controller forms the first band pattern during a time period that is different from a time period during which image formation on a print medium is performed.

17. The image forming apparatus according to claim 10, further comprising:

a developer removing member that removes the first developer image that is formed on the first image carrier.

18. An image forming apparatus, comprising:

a first image carrier;

a first exposure part that forms a first electrostatic latent image in dot units on the first image carrier;

a first development part that develops the first electrostatic latent image of the first image carrier using a first developer; and a controller that forms an inclined first band pattern of which bands incline with respect to a main scanning line direction on the first image carrier with the first exposure part and the first development part, a second image carrier;

a second exposure part that forms a second electrostatic latent image in dot units on the second image carrier; and a second development part that develops the second electrostatic latent image of the second image carrier using a second developer, wherein the controller determines a first cumulative exposure dot number in the first exposure part based on print data, the first cumulative exposure dot number being determined as a cumulative dot number used by the first development part since the first development part starts developing the first electrostatic latent image, determines whether or not to form a first developer image having the first band pattern based on the first cumulative exposure dot number, determines a second cumulative exposure dot number in the second exposure part based on the print data, and determines whether or not to form a second developer image having an inclined third band pattern on the second image carrier based on the second cumulative exposure dot number.

19. The image forming apparatus according to claim 18, further comprising:

an environment detector that detects an environmental condition, wherein the controller varies the first band pattern and the third band pattern according to the environmental condition detected by the environment detector.

20. The image forming apparatus according to claim 18, wherein the controller varies the first band pattern and the third pattern according to an operation time.

21. The image forming apparatus according to claim 20, wherein the controller determines a first cumulative exposure dot number in the first exposure part based on first print data, and determines a second cumulative exposure dot number in the second exposure part based on second print data, and the operation time is determined based on the first cumulative exposure dot number and the second cumulative exposure dot number.

* * * * *